US005951162A

United States Patent [19]

Weetman et al.

[11] Patent Number: 5,951,162

[45] Date of Patent: Sep. 14, 1999

[54] MIXING IMPELLERS AND IMPELLER SYSTEMS FOR MIXING AND BLENDING LIQUIDS AND LIQUID SUSPENSIONS HAVING EFFICIENT POWER CONSUMPTION CHARACTERISTICS

[75] Inventors: Ronald J. Weetman; Keith McDermott, both of Rochester, N.Y.

[73] Assignee: General Signal Corporation, Rochester, N.Y.

[21] Appl. No.: 09/033,889

[22] Filed: Mar. 3, 1998

Related U.S. Application Data

[60] Provisional application No. 60/036,584, Mar. 14, 1997.

[51] Int. Cl.[6] ..... B01F 7/22

[52] U.S. Cl. ..... 366/328.1; 366/330.3; 416/223 R; 416/228; 416/235; 416/DIG. 2; 416/DIG. 5

[58] Field of Search ..... 366/270, 330.1–330.7, 366/328.1–328.4; 416/223 R, 228, 235, DIG. 5, DIG. 2

[56] References Cited

U.S. PATENT DOCUMENTS

| | | | |
|---|---|---|---|
| 42,887 | 5/1864 | Tibbits . | |
| 61,494 | 1/1867 | Westover . | |
| 1,150,213 | 8/1915 | Little . | |
| 1,612,028 | 12/1926 | Kincaid et al. . | |
| 1,916,192 | 7/1933 | David . | |
| 2,045,918 | 6/1936 | Moody . | |
| 2,193,686 | 3/1940 | Craddock . | |
| 2,320,733 | 6/1943 | McIntyre . | |
| 2,431,478 | 11/1947 | Hill . | |
| 2,688,992 | 9/1954 | Russo . | |
| 3,044,559 | 7/1962 | Chajmik . | |
| 3,169,694 | 2/1965 | Borchers . | |
| 3,514,215 | 5/1970 | Williams . | |
| 3,885,886 | 5/1975 | Richter . | |
| 4,004,786 | 1/1977 | Stephens . | |
| 4,089,618 | 5/1978 | Patel | 416/228 |
| 4,102,600 | 7/1978 | Schwab . | |
| 4,147,437 | 4/1979 | Jonqueres . | |
| 4,376,515 | 3/1983 | Soe . | |
| 4,411,598 | 10/1983 | Okada . | |
| 4,468,130 | 8/1984 | Weetman | 366/330.2 |
| 4,571,090 | 2/1986 | Weetman et al. | 366/270 |

(List continued on next page.)

OTHER PUBLICATIONS

Morehouse Industries Product Literature, date unknown.
Ekato Product Literature, date unknown.

*Primary Examiner*—Charles E. Cooley
*Attorney, Agent, or Firm*—Harris Beach & Wilcox, LLP.

[57] ABSTRACT

A mixing process may be carried out in a tank of a certain diameter. The process may also be constrained to the use of an impeller of certain diameter in order to obtain the flow pattern desired to carry out the process. The power consumption of the system which may be expressed in terms of flow per unit (Q/P) is optimized for the impeller diameter to tank diameter (D/T) constraint by utilizing an axial flow blade, preferably having camber and a tip chord angle at the tip and an angle near the attachment to the shaft (the hub) which rotates the impeller, where the tip chord angle and the twist the difference between the blade angle (between the chord and a plane perpendicular to the axis of rotation of the shaft between the tip and hub) are varied in opposite senses; for example, increasing the tip chord angle to provide a more D/T for a more optimum Q/P to which the process is constrained and then reducing the twist to maintain the power efficiency at the higher tip chord angle. The freedom to increase the tip chord angle and reduce the twist provides flexibility enabling the use of a limited number, say three, of hubs, thereby reducing the cost of the impeller system. The efficiency of the impeller is further increased by reducing tip vortices using slots in the tip which have an effect on the flow pattern similar to the effect of proplets but at reduced cost of fabrication. Where additional turbulence is required so as to establish shear forces in the fluid or fluid suspension being mixed, the blade segments which define the slots may be twisted at angles different from the tip chord angle. These twisted segments increase turbulence and shear the material being mixed.

15 Claims, 15 Drawing Sheets

U.S. PATENT DOCUMENTS

| | | | |
|---|---|---|---|
| 4,636,143 | 1/1987 | Zeides . | |
| 4,721,394 | 1/1988 | Casto et al. . | |
| 4,722,608 | 2/1988 | Salzman et al. . | |
| 4,802,771 | 2/1989 | Weetman . | |
| 4,896,971 | 1/1990 | Weetman et al. | 366/330.2 |
| 4,913,670 | 4/1990 | Spranger . | |
| 5,112,192 | 5/1992 | Weetman | 366/330.5 |
| 5,152,606 | 10/1992 | Borraccia et al. . | |
| 5,158,434 | 10/1992 | Weetman . | |
| 5,226,783 | 7/1993 | Mita . | |
| 5,246,343 | 9/1993 | Windsor et al. . | |
| 5,297,938 | 3/1994 | Von Essen et al. . | |
| 5,326,168 | 7/1994 | Miura | 416/223 R |
| 5,344,235 | 9/1994 | Weetman et al. | 366/330.5 |
| 5,525,269 | 6/1996 | Connolly et al. | 366/270 |
| 5,813,837 | 9/1998 | Yamamoto et al. | 366/330.3 |

SLOT W/ VORTEX GENERATORS
INHIBIT NORMAL TIP VOTEX
FROM PRESSURE BLADE SURFACE TO
SUCTION BLADE SURFACE AT TIP

BLADE SECTION (PERPENDICULAR TO DIAMETER)

* Length from LE at point of maximum camber

MIXING IMPELLERS AND IMPELLER SYSTEMS FOR MIXING AND BLENDING LIQUIDS AND LIQUID SUSPENSIONS HAVING EFFICIENT POWER CONSUMPTION CHARACTERISTICS

This application claims the priority benefit of my provisional application Ser. No. 60/036,584, filed Mar. 14, 1997.

DESCRIPTION

The present invention relates to impellers and impeller systems for mixing and blending applications and particularly for mixing and blending liquids and liquid suspensions in processes which are constrained by the diameter of the tank in which mixing is carried out and the diameter of the impeller. The term "diameter of the tank" is intended to include the equivalent dimension of non-circular tanks, which effect mixing processes in a way equivalent to their effect for circular tanks.

The invention is especially suitable for use in applications where the impeller speed is to be limited to incremental speeds which are available from different motor and gear box combinations which are available only in incremental sizes of horse power and speed, particularly gear boxes have torque ratings which vary in incremental steps. It is desirable also in most applications to reduce the motor size and power to minimize operating costs. Similarly the smaller and lower torque rated gear boxes have a cost advantage over larger gear boxes and the enabling selection of the lower torque output gear box will reduce the initial cost of the installation of the mixer system. In addition, it is desirable, in the interest of reliability, to minimize the mechanical forces on the impeller and the impeller shaft. Such forces are amplified at the natural or resonant frequency of the impeller and shaft assembly. Accordingly it is desirable to limit the speed of the shaft and the mixer to be less than 80% of the speed which gives rise to resonant conditions. Also the mixing process may require certain flow patterns which limit the choice of diameter of the impeller with respect to the diameter of the tank (D/T).

FIG. 11 is a curve for solid suspension mixing applications which shows that there is an optimum D/T for optimum power utilization in the mixer. Still another constraint on mixer impeller design resides in the angles to which the blades of the impellers are attached at the hub which attaches the blades to the shaft. It is desirable to limit the hub angles which are required for a large range of mixing processes so that the number of hubs which are needed to attach the impeller is minimized. In addition, the number of hubs which is needed is further minimized by limiting the range of torque which is required, since hubs of different size and torque ratings are needed to match shafts of different diameter.

The invention contributes to the improvement of impeller system by allowing power levels to be reduced, and enabling impeller diameter to tank diameter (D/T) ratio, for efficient operation, to be more optimized. The invention also enables the use of motors and gear boxes in which are available in incremental HP and speed/torque sizes and also minimizes the number of hubs (less hubs than impellers). It has been found, in accordance with the invention that by providing an additional degree of freedom in blade shape selection (beyond impeller diameter and speed), quite surprisingly leads to these impeller system improvements, and enhances the power efficiency (Q/P) of the system in spite of the adverse effects on efficiency of constraints on the impeller system design, for example, the impeller diameter, tank diameter and choices of speed.

It has been the practice in the design of mixing impellers to optimize the impeller for flow efficiency by changing the blade angle and by twisting the blades so that the tip chord angle (TCA) is less than the hub chord angle. Changes in the TCA have been accompanied by a change in the same sense of the blade angle at the hub; the theory being that the increase in the hub angle was necessary to enable the portion of the blade near the hub to be loaded in a manner similar to the portion near the tip. Such technology is described in U.S. Pat. No. 4,468,130 issued to Ronald J. Weetman on Aug. 28, 1994. Mixing technology as taught by Weetman U.S. Pat. No. 5,112,192 issued May 12, 1992 also includes using the twist to control blending time in the transitional flow regime. Weetman shows in his 5,112,192 patent that increasing the twist decreases the blending time which is the desired result in the transitional flow regime. Such increase in twist is consistent with the axial flow impeller technology in accordance with the Weetman U.S. Pat. No. 4,468,130 patent in that both the hub angle and the tip chord angle change in the same sense; that is for an increase in the tip chord angle the hub angle is increased to at least maintain the same twist.

Generally, mixing technology has followed the practice described in the above-referenced Weetman patents, that hub and tip angles are changed in the same sense to maintain or increase the twist.

It has been discovered in accordance with the invention that the hub angle and the tip chord angle of the blades of the impeller when changed in the same sense so as to provide blade angles (such as tip chord angles) which are inversely related to the twist has the advantage of increasing or maintaining the efficiency of the impeller. This surprising result has the advantages of enabling the tip chord angle to be selected in consonance with the D/T constraints of the mixing process. Particularly, the power number, which is affected by the blade angle at the tip (TCA), may be increased so as to maintain efficiency when the D/T deviates from the optimal D/T. The efficiency of the impeller has been found to be maintained when the twist is changed in a sense opposite to the sense of change of the blade angle at the tip. An impeller embodying the invention may have a tip chord angle which is greater than the optimum tip chord angle for the D/T of the system. By decreasing the twist, however, the power efficiency of the system is maintained or improved. In addition, the advantages of being able to reduce the twist, enables the hub angles to be limited and yet meet a large number of mixing process requirements. The improvements in efficiency also enables the speed of the impeller to be reduced and avoids problems of operating at or near resonant frequency. Lower power and torque enables the use of less expensive, lower torque gear boxes and motors.

The advantages of the invention and what is believed to be the theoretical basis therefore (although the invention is not limited to any theory of operation) will be more apparent from the curves of FIGS. 11, 12 and 13. FIG. 11 shows the power required versus the power for an optimum D/T versus the impeller diameter over the tank diameter. The optimum D/T as shown in the curve is approximately 0.35. This curve is for mixing of slurries of solid in liquid, which suspends the solids in the liquid, and utilizes an axial flow impeller in a tank. The curve shows that if the impeller diameter increases above the D/T above the optimum, for example 0.45 instead of 0.35, a 37% increase in power is required for the same process. An increase of D/T from 0.35 to 0.55 causes a 147% increase in power. Accordingly, there is a very large power increase, for a large D/T, over the optimum D/T. The invention allows a mixing system with an axial flow impeller to have blades with a tip chord angle compatible with the D/T required for the mixing process. It is known that the TCA is related to the power number and that by increasing the TCA the power number of the mixing system can be increased. Power number is related to the power, the density (ρ), the speed of the impeller and the diameter of the impeller in accordance with the equation given in J. Y. Oldshoe, Fluid Mixing Technology, Chemical Engineering, McGraw-Hill Publications Co., New York, N.Y. (1983), equation 8-26, page 186. An impeller with an increased power number has, in accordance with generally accepted mixing technology, been subject to a decrease in efficiency. Such a decrease of efficiency is illustrated in FIG. 12 which It shows curves illustrating the efficiency in terms of Q/P with TCA. Curve (a) shows an optimum Q/P efficiency at a 22° TCA and a drop off in efficiency at lower and higher TCAs. If the 12° twist angle is maintained and the TCA is increased to 32°, there is a decrease in efficiency as shown in curve (a). This decreased efficiency sacrifices at least some of the efficiency gained by increasing the power number (increasing the TCA) which enables the diameter of the impeller to be reduced (if required) so that D/T can approach the optimum D/T for the process. Following generally accepted mixing technology, it would be expected that with the 12° twist the tip of the blade as well as the area of the blade near the hub would both be loaded so as to obtain an efficient impeller blade. Thus, if the tip is decreased, a decrease in efficiency would be expected at 32° TCA, as shown in curve (b). This is believed to be because the inside of the blade is not being loaded as much as with the 12° twist. Quite unexpectedly and as shown in curve (c) the result is that the efficiency (Q/P) was not reduced and stayed substantially constant for a 2° twist when the TCA is 32°. It will be seen that the twist changed in a sense opposite from the TCA yet an increase in efficiency (over a constant twist case) followed from the increase of the TCA and enabled D to be reduced, so as to approach optimum D/T was retained.

Theoretically, it is believed that the unexpected result and improvement in efficiency is due to the three dimensional effects of the separation of flow on the impeller blade. For a blade made from flat stock, for example, as the TCA is increased above the optimum 22°, the three dimensional effects on the flow causes separation. Also the twist engenders a radial component along the blade which inhibits the two dimensional characteristics of an efficient lifting blade section. The decrease in efficiency is shown in FIG. 12 for a constant 12° twisted blade. As the loading on the tip occurs, also increased is the loading on the end of the blade opposite from the (tip (near the hub). Increase in the loading near the hub results in a radial component of flow outward from the hub to the tip. The secondary radial flow inhibits the flow efficiency near the hub and also near the tip. By reducing the twist, that is changing it in a sense opposite to the change in the TCA, the loading near the hub has less effect on the loading near the tip. Thus the efficiency is held relatively constant. In other words as the loading of the tip of the blade is increased, the blade is unloaded near the hub and the result on the overall efficiency is positive. That is, as shown in FIG. 12 curve (c), the overall efficiency is held relatively constant.

FIG. 13 has two curves which illustrate the reduction in Q/P as a function of twist angle. The curve labeled "impeller number 1" illustrates the case where the twist, for example, for a 32° TCA varies from 2° to 12°. The curve labeled impeller number 2 is for an impeller with a smaller, say 24° TCA which may be a cast blade impeller, which has a large twist shown plotted as varying between 14° and 36°. The curves of FIG. 13 show the relative change relative to twist angles of 12° and 14° respectively.

In summary, the curves of FIGS. 11, 12 and 13 show that as a tip chord angle increased 22° to 32° (for a constant angle near the hub), the twist varied from 12° to 2° and the flow efficiency (Q/P) stayed relatively constant. This is an unexpected result because of the decrease normally obtained when increasing TCA about 22° while holding the twist constant, and the expected decrease when decreasing the twist. It is believed that this result may flow from three dimensional radial outward flow effects. By limiting these effects, efficiency is retained or improved.

An impeller in accordance with the invention might have planform increasing in width from the tip to the hub, a camber that is relatively constant over the length of the blade (up to the surface which is generally flat for attachment to the hub). The planform may however be generally rectangular as shown in Weetman U.S. Pat. No. 4,896,917. The camber, namely the maximum distance between the mean line of the blade and the chord over the length of the blade in the radial direction desirably remains constant. Further, it is desirable that the width of the blade be maintained constant or increased towards the hub. The efficiency of the impeller is effected mainly by the blade angles (the TCA and the twist). Camber and width also effects loading of the blade and its efficiency, but camber effects efficiency less than the blade angle, and width effects efficiency less than camber, in most cases.

It is another feature of the invention to reduce the circulation around the tip of the blades of the impeller (called the tip vortex) thereby increasing the efficiency of the pumping action, but without the need for proplets on the tip as, for example, shown in FIG. 9 of Weetman U.S. Pat. No. 4,468,130. This is accomplished by means of slots which extend from 5 to 15% of the radial length of the blade (the distance between the tip and the rotating axis of the shaft) and which preferably taper outwardly towards the tip. It is believed that the flow upward through the slots counteracts flow around the tips. Moreover, the slots reduce the weight of the impeller thereby increasing its critical speed at which resonance occurs.

It is a further feature of the invention to twist the sections of the blade at the tip adjacent the slot thereby generating vortices and adding shear while still maintaining the axial flow pattern.

Accordingly it is an object of the present invention to provide an improved impeller system which utilizes blades which enhance the efficiency of the system for various mixing processes.

It is a further object of the present invention to provide an improved impeller system with impellers having blades utilizing the relationship between the blade angle and the twist of the blade to enable selection of blade angles at the tip which provide power numbers lending themselves to blade diameters which obtain D/T for more optimum efficiencies.

It is a still further object of the present invention to provide improved impeller systems which require a smaller set of different blade angles at the shaft or hub end of the blade so that the number of hubs required for attachment of different blades is minimized.

It is a still further object of the present invention to provide an improved impeller system having an inverse relationship between tip chord angle and twist so as to enable increasing of the power number of the impeller and selection of impeller diameters for optimizing the efficiency of the impeller system for the diameter of the tank in which the impeller is to be used.

It is a still further object of the present invention to provide improved impellers where the blade angle at the tip is greater than 22° and the twist is less than 12°.

It is a still further object of the present invention to provide an improved impeller for axial flow which is an air foil having camber and twist where the tip chord angle is about 32° and the twist is about 2°.

It is a still further object of the present invention to provide an improved impeller system having slots at the tips of the blades of the impeller which reduce tip vortices and increase efficiency and which may be twisted between the slots so as to generate shear in the liquid or liquid suspensions being mixed.

The foregoing and other objects, features and advantages of the invention will become more apparent from a reading of the following description in connection with the accompanying drawings in which.

Figure 3:
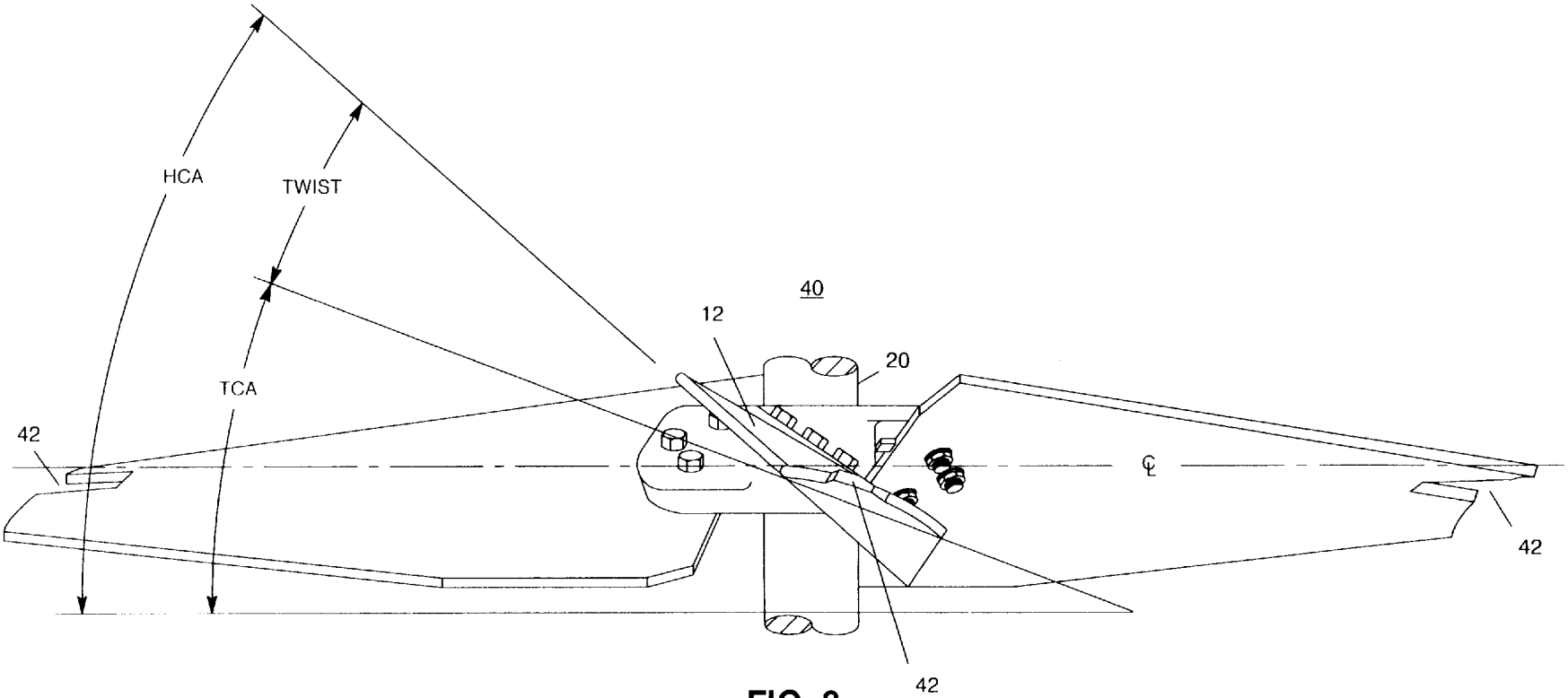
FIG. 3 is a plan view of an impeller similar to that shown in FIG. 1, but having slots in the tip ends thereof for reducing tip vortices.
Figure 4:
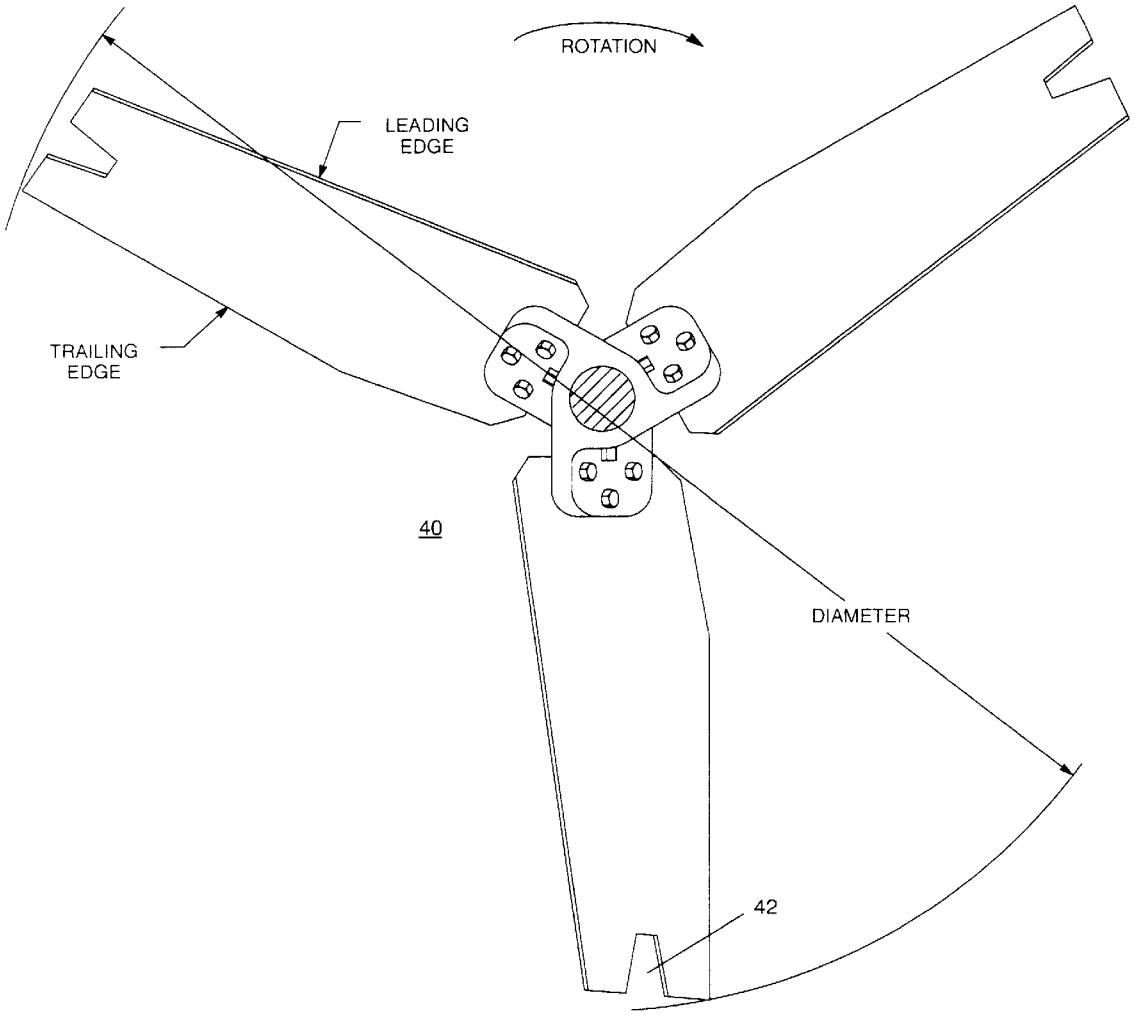
FIG. 4 is a plan view of the impeller shown in FIG. 3.
Figure 5:
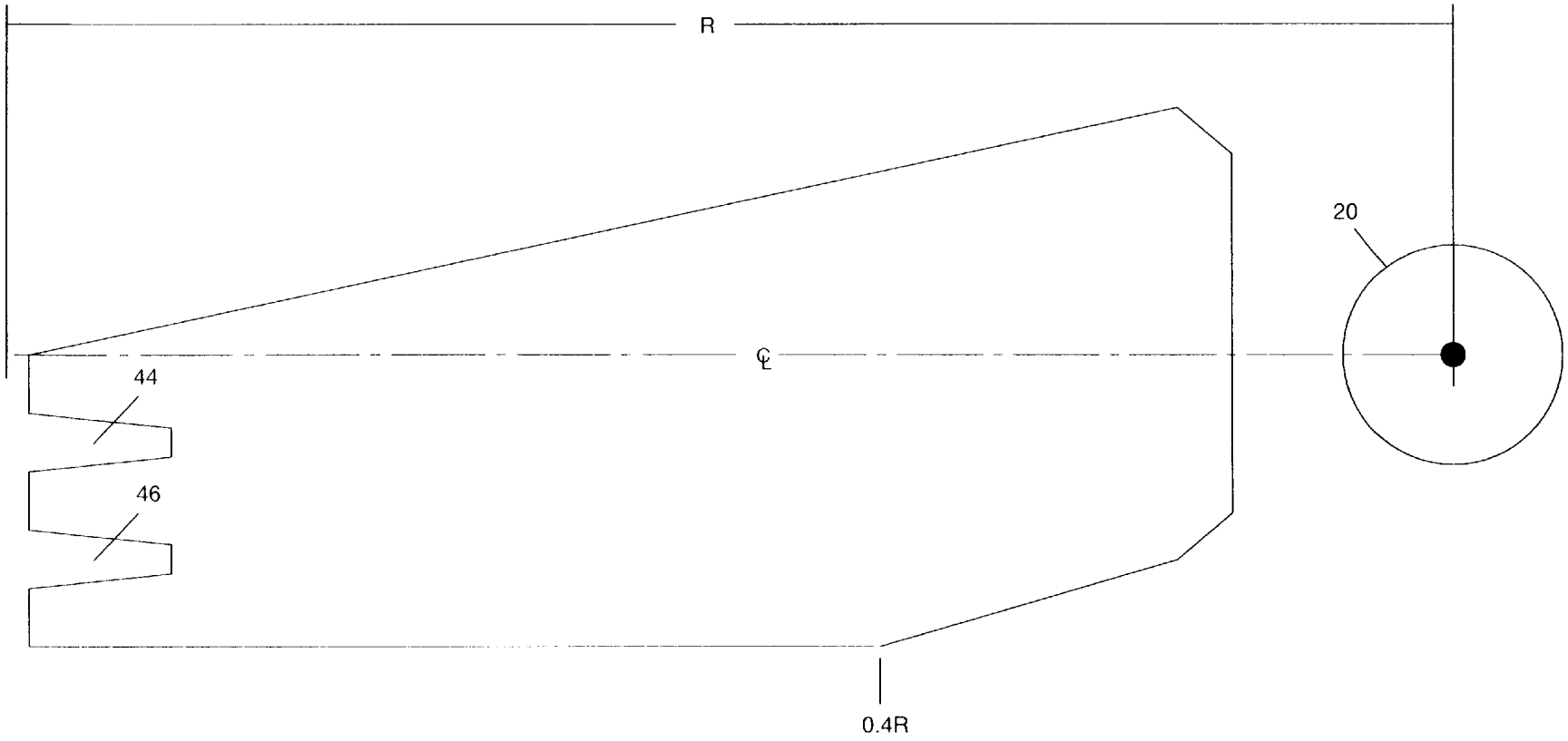
FIG. 5 is a planform of a blade similar to the blades of the impeller shown in FIGS. 3 and 4 but having a pair of adjacent slots.
Figure 7:
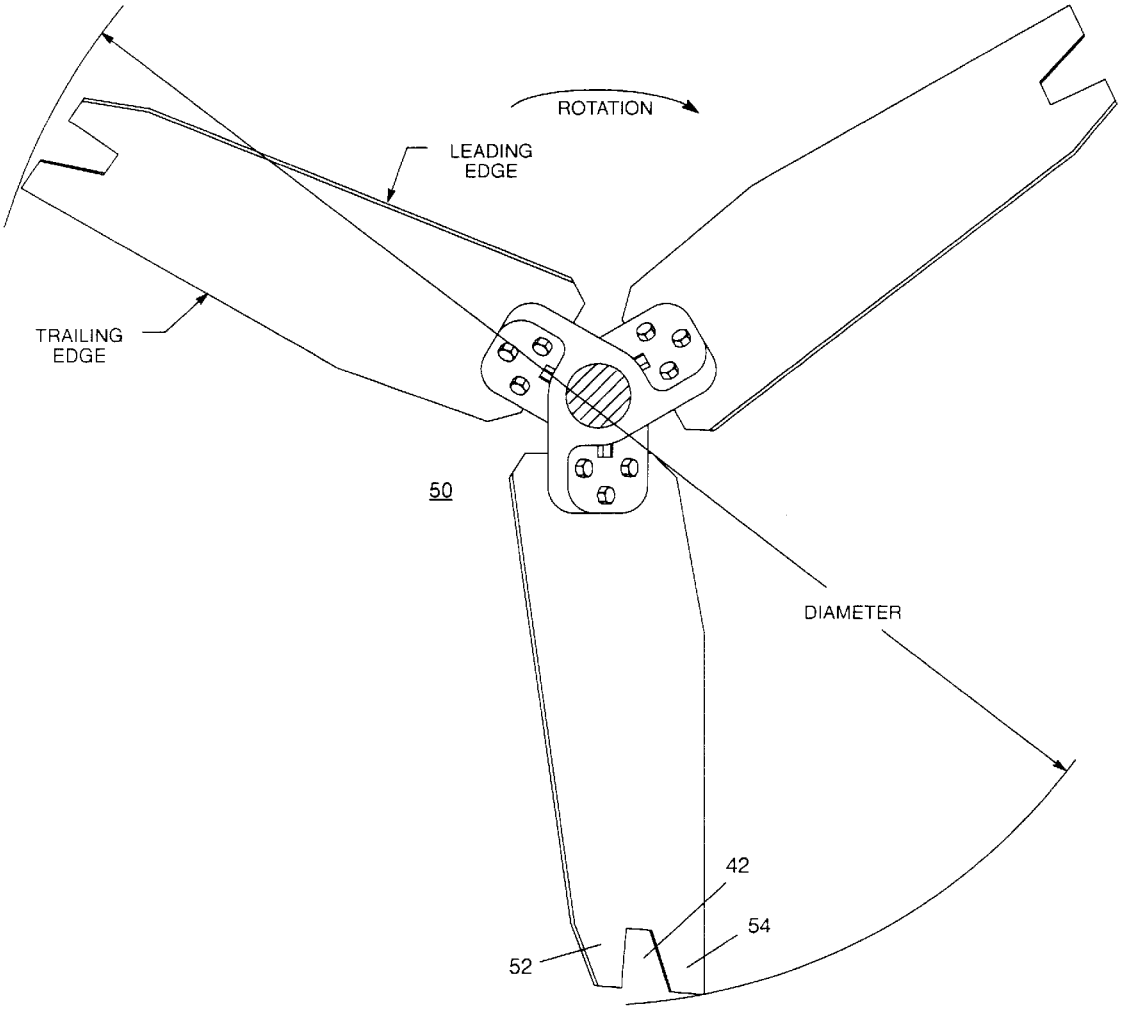
FIG. 7 is a plan view of another impeller in accordance with the invention similar to the impeller of FIG. 4.
Figure 7C:
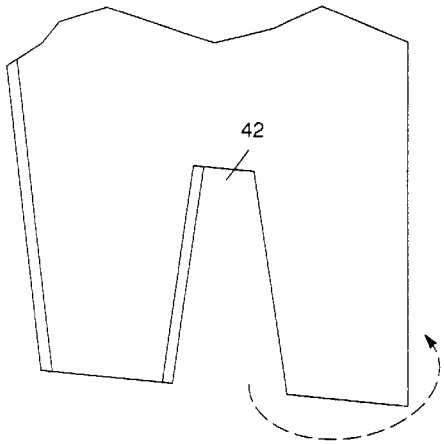
Figure 7A:
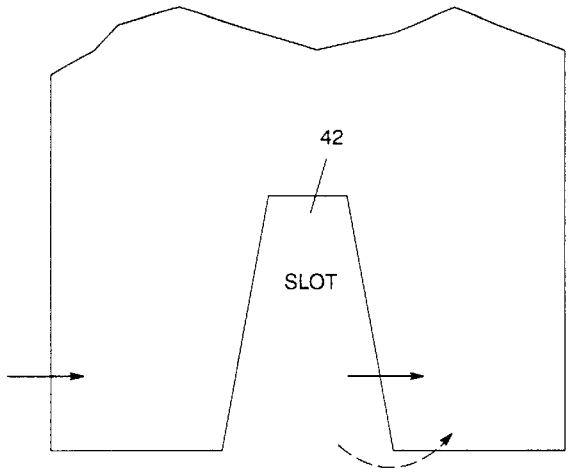
Figure 7B:
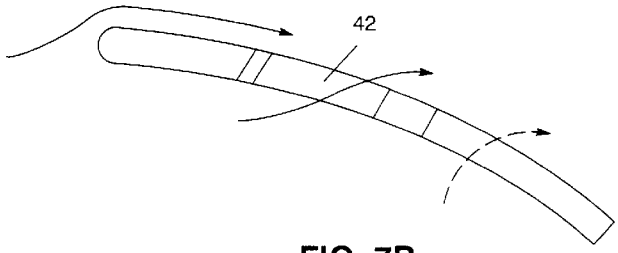
Figure 8:
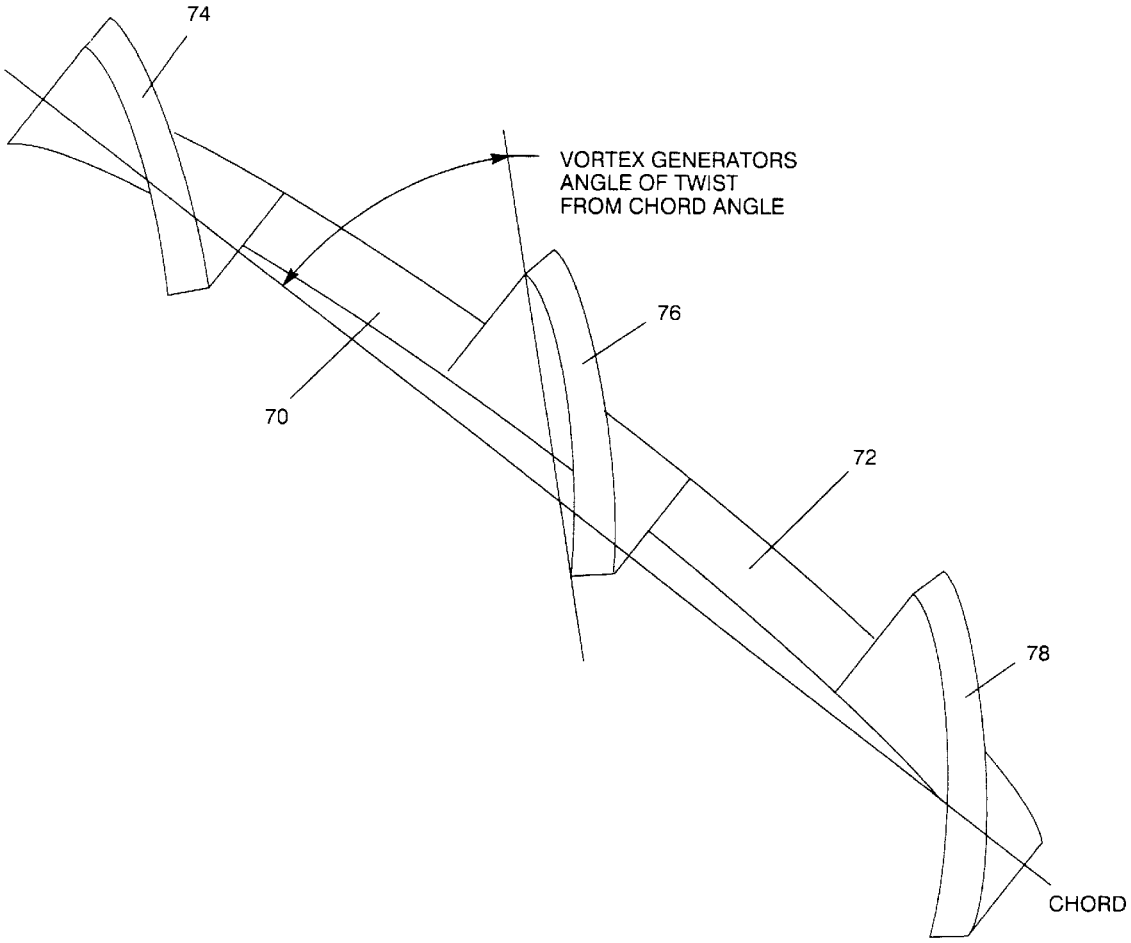
Figure 9:
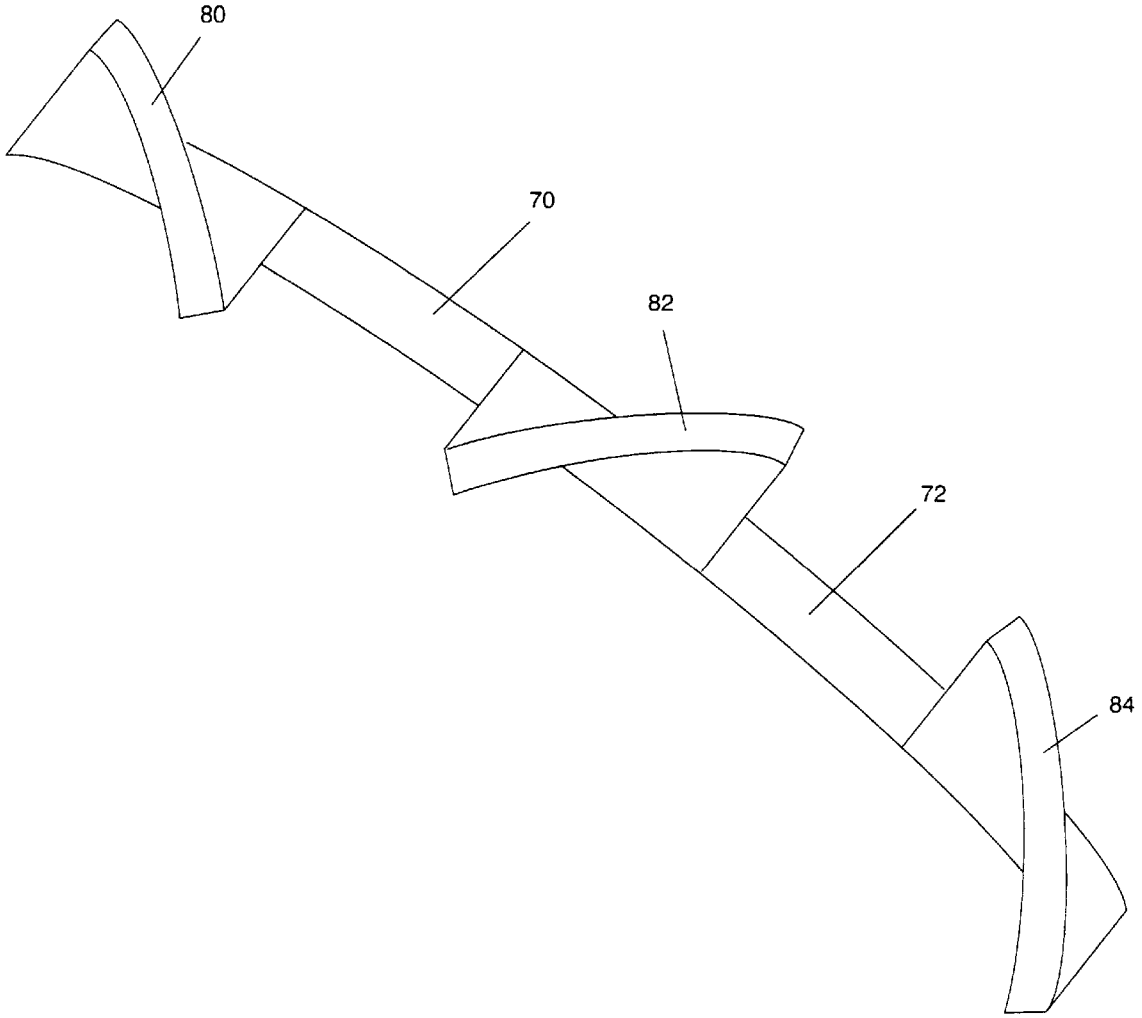
Figure 10:
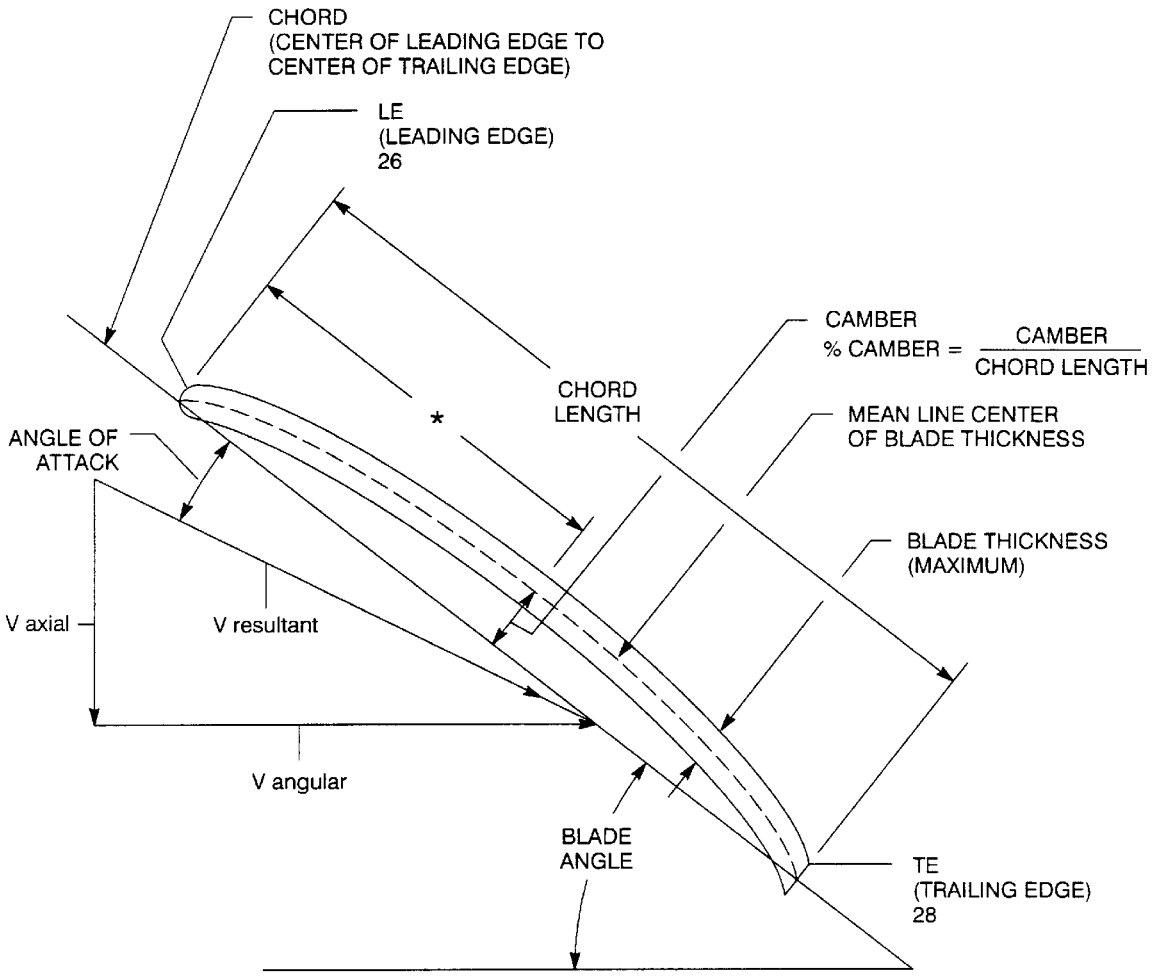
Figure 11:
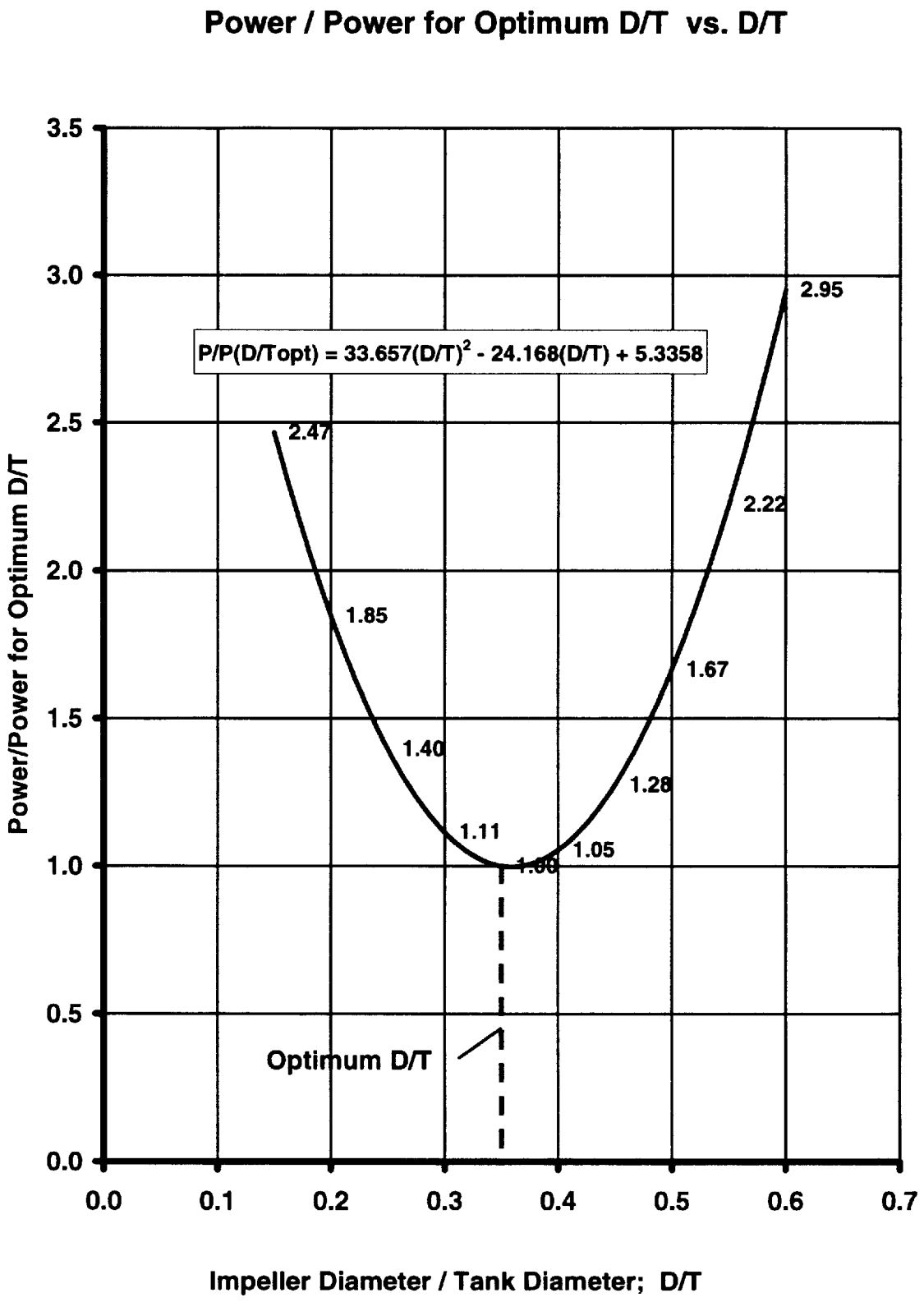
Figure 12:
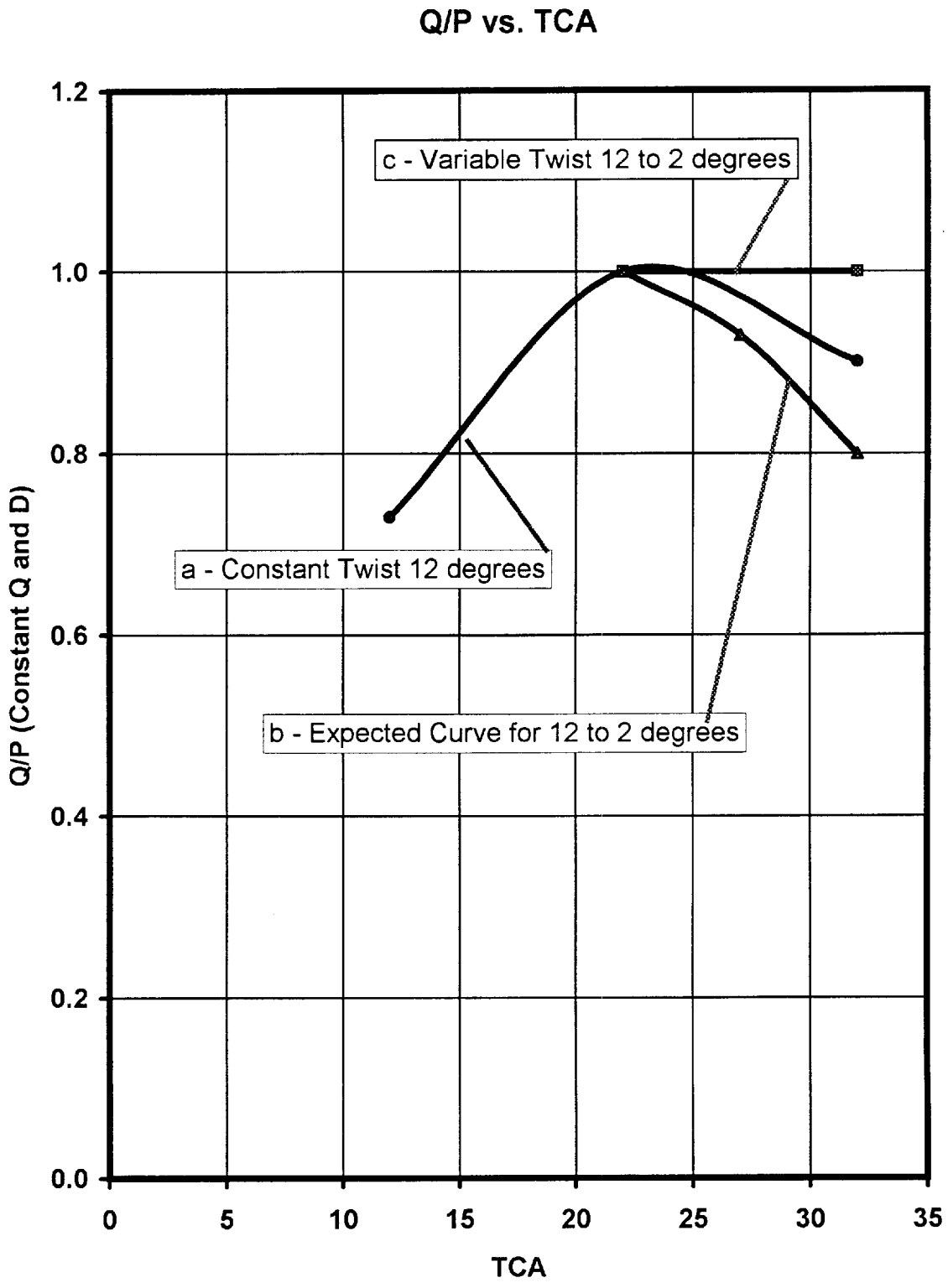
Figure 13:
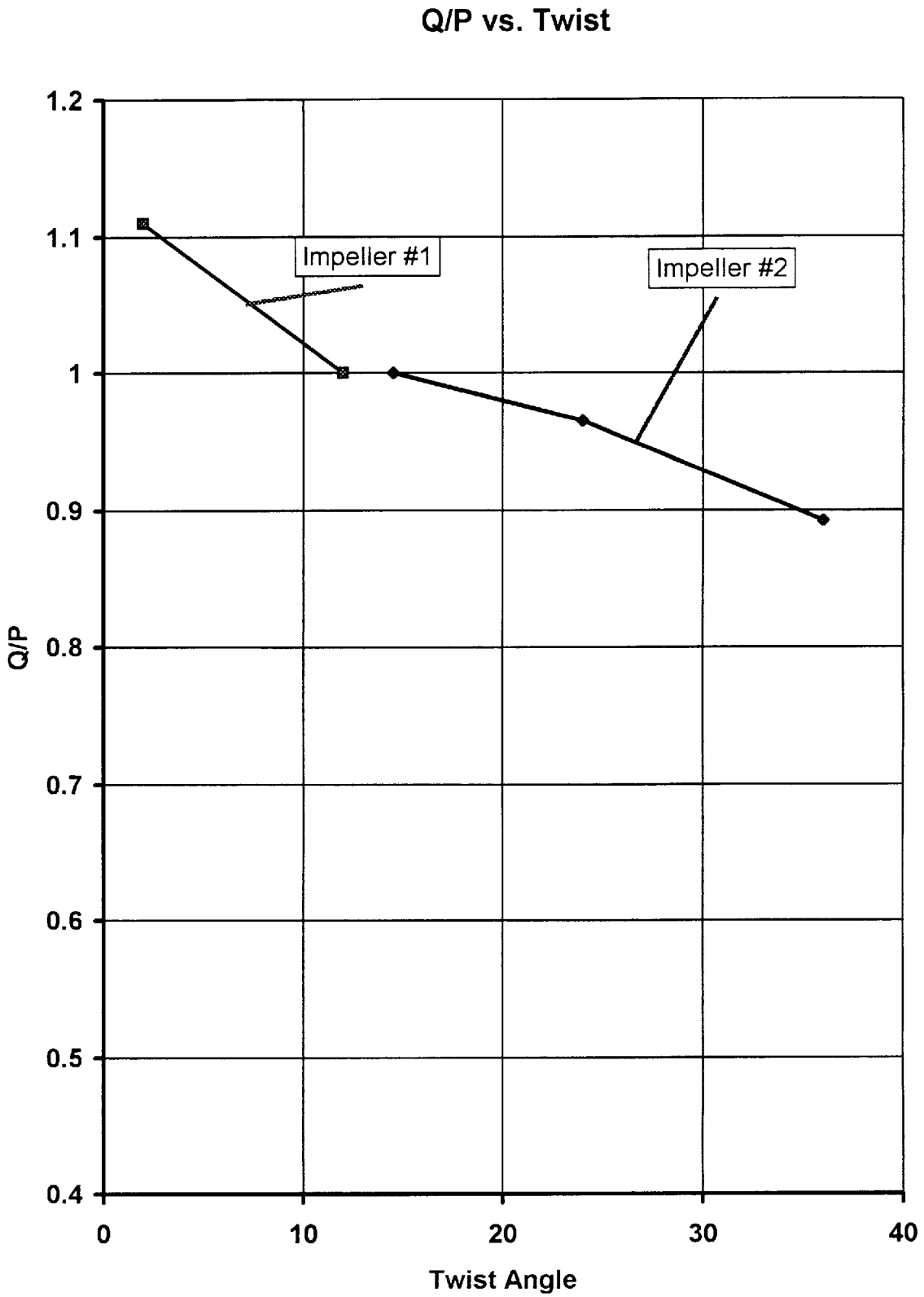

FIG. 7A, B and C are schematic diagrams illustrating the flow around and through the slot in the impeller shown in FIGS. 3 and 4 to illustrate that the flow through the slot counteracts the formation of tip vortices;

FIG. 8 is an end view of a blade such as shown in FIG. 5 illustrating the twisted segments which provide increased shear effects;

FIG. 9 is a view similar to FIG. 8 but showing that the segments may be twisted or tilted in different directions;

FIG. 10 is a diagram illustrating the terms which are used in the description of the invention and the preferred embodiments thereof, namely the chord, blade angle, angle of attack, leading edge, trailing edge, camber, mean line and blade thickness; and FIGS. 11, 12 and 13 are plots illustrating the effect of D/T, TCA and twist on the efficiency of an impeller system which have been discovered in accordance with the invention.

Figure 1:
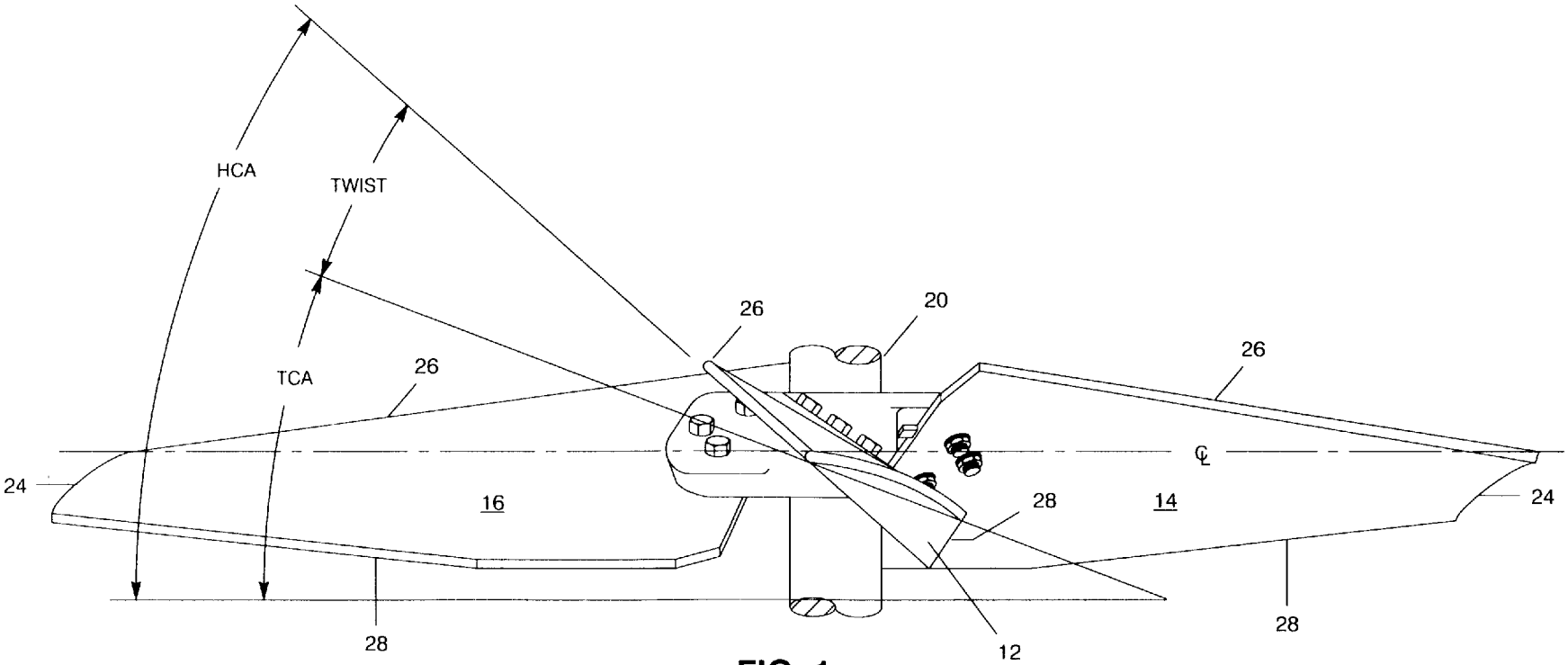
FIG. 1 is an elevational view of an impeller in accordance with the invention.
Figure 2:
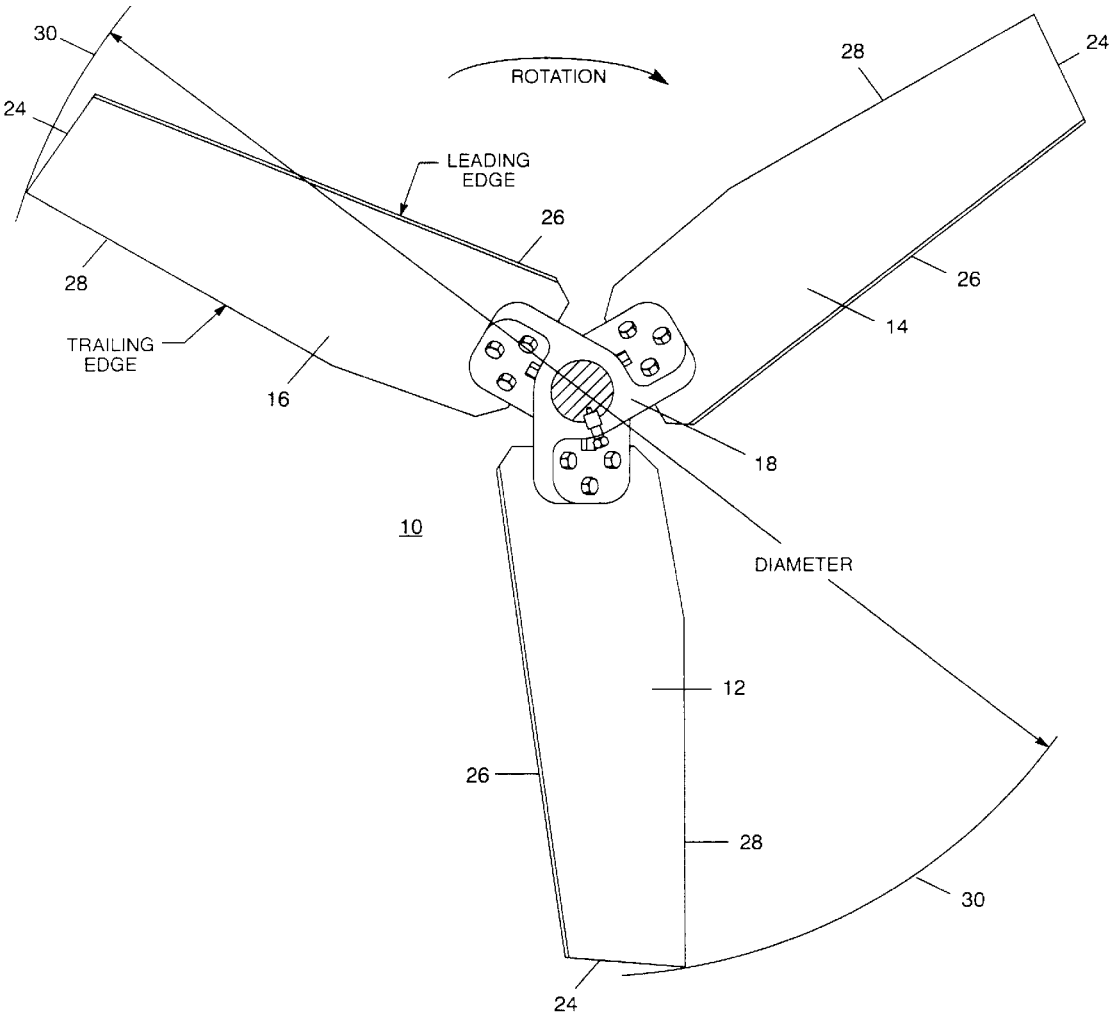
FIG. 2 is a plan view of the impeller shown in FIG. 1.

Referring to FIGS. 1 and 2 there is shown a mixing impeller 10 having three blades 12, 14, and 16 assembled 120° apart on a hub 18 which is attached to a shaft 20. The blades are attached to the hub by bolts on flat surfaces of the hub which are oriented at like angles to a plane perpendicular to the axis of rotation of the shaft 20. The inner ends or hub ends of the blades are flat and are attached to the surfaces so as to set the hub angles of the blades, that is their angles at the hub ends of the blades. The hubs may be castings of steel or a material like that from which the blades are made. Such castings require tooling which may be expensive especially where the hubs are investment castings. The need for only a limited number of blade angles to meet the needs of most mixing processes therefore reduces the tooling necessary to make the molds from which the hubs are cast and contributes to a reduction in cost of the impellers.

Each of the blades 12, 14, and 16 may be identical and may be formed in a press. The blades have tips 24 and leading and trailing edges 26 and 28. The tips lie along the circumference of a circle 30 defining the swept diameter of the impeller, which is the diameter through the axis of rotation of the shaft 20. In the illustrated impeller 10, the leading edge is relieved or offset radially inwardly from the circle 30. The leading edge may be straight, as shown, or curved. The blades are air foils having camber and twist except at their hub ends where they are flat for attachment to the hub. Relief from the camber at the hub ends is not required if the blades are welded to the hubs. The high pressure or pressure surface of the blade is the surface facing the direction in which the fluid is driven. Accordingly, when the impeller is rotated in the clockwise direction, as shown, axial flow is produced in the downward direction (downward pumping) in the liquid or liquid suspension in the tank.

The tank is not shown in the figures. It has a diameter T and the impeller is spaced a distance C above the floor or bottom of the tank when solids suspension processes are carried out. The height C is variable depending upon the nature of the process and the material being mixed or circulated in the course of the process. Reference is made to U.S. Pat. No. 4,468,130 which shows an axial flow impeller in a tank and the circulation obtained from such an impeller when it is down pumping. The center line of the impeller which is in a plane perpendicular to the axis of the shaft bisect the height of the hub and the height C is measured from that center line.

Referring to FIG. 10, a sectional view perpendicular to the diameter of the impeller illustrates the terms which are used to describe the characteristics of the air foil. The mean line is the center of the thickness of the blade. In the illustrated typical blade 12, the blade thickness is constant over the width of the blade except at the leading edge which is contoured, but a flat leading edge which is perpendicular to the mean line may sometimes be used. The chord is the distance between the intersection of the mean line and the leading and trailing edges of the blade The blade angle is the angle between the chord and a line at the intersection of a plane perpendicular to the axis of rotation, which is in the same plane as the chord where the blade angle is being measured. The blade angle at the tip is the tip chord angle (TCA). The blade angle at the hub is the hub chord angle (HCA). The overall twist of the blade is the difference between the HCA and the TCA. The twist may be measured at different radial sections of the blade and can vary along the radial length of the blade. The twist may vary linearly or nonlinearly. The twist in the herein described blade has an approximately linear variation in twist along the radial length thereof between the hub and the tip.

The angle of attack is the angle between the chord and the resultant velocity vector between the axial velocity and the angular velocity Q where the cross section is taken. The loading of the blade varies with the angle of attack and camber of the blade and with the width of the blade. Since the angle of attack depends upon the blade angle, loading also depends upon the blade angle. The camber is the distance between the mean line and the chord and there is a point of maximum camber where the camber of the blade is taken. Camber is expressed as the camber distance over the chord length at the maximum camber distance usually as a percentage. The camber is measured the same way even where the thickness of the blade is not constant as may be the case where the blade is molded from plastic or other or composite material or cast from metal.

The width of the blade is the distance between the leading and trailing edges and corresponds to the chord length for an air foil. The width may also be measured before forming in a planform of the blade. FIG. 5 shows a blade of planform. The FIG. 5 blade is similar to the blade 12, but has a pair of slots extending radially inwardly from the tip which reduce tip vortices, as will be explained more fully hereinafter.

The blades have a width which increases from the tip to approximately 0.4 R which is 40% of the radius of the blade measured along the diameter. Radially inward from 0.4 R, the width remains approximately constant. The hub end of the blade may be chamfered at the leading and trailing edges to facilitate the attachment of the blade to the hub and to provide clearance between adjacent blades. The chamfered edges are not essential, but are a convenient way of indicating the HCA and twist of the particular blade. For example, three different blades may be identified by chamfering the leading edge, the trailing edge or both the leading and trailing edges of the blade. The width of the blade depends upon the application and particularly the process. For example, in a sparging or mass transfer process or where the medium being mixed is high viscosity (low Reynolds number in the transition region for the media) generally square shaped blades such as shown in U.S. Pat. No. 4,896,971 may be used.

The blades provided in accordance with the invention may have different blade angles, and total twist. However, the blade angle at the tip (TCA) which is selected is inversely related to the twist so as to enable to efficient operation in terms of Q/P in the tank of diameter T where the mixing process is being carried out, as explained in connection with FIGS. 11 through 13 above. The preferred embodiments of the invention where the surprising results obtained by the inverse relationship of twist to TCA are particularly significant where the tip chord angle is greater than the tip chord angle in impellers which are presently in extensive use such as the A310 described in U.S. Pat. No. 4,468,130 and the A315 and A320 described in U.S. Pat. No. 4,896,971 and the A410 described in U.S. Pat. No. 5,112,192. These known impellers have a TCA ranging from 20° to 28°, usually 22°, and a twist which is approximately 16° or 18° or even a 30° twist in the case of a cast blade impeller, such as the A410 impeller. The model numbers identified above are available from LIGHTNIN, a unit of General Signal Corporation having its headquarters in Rochester, N.Y., USA. Generally, the TCA is greater than 22° and the twist is less than 12°. A family of impellers having three different TCA and twists, thus requiring only three twists and two HCAs (therefore only two hub castings) have been found to satisfy a wide range of mixing process requirements. Particularly one of these impellers has a TCA of 12°, a twist of 12° and an HCA of 24°. Another of these impellers has a TCA of 22°, a twist of 12° and an HCA of 34°. The third of these impellers also has an HCA of 34° but the TCA is 320 and the twist is 2°.

Referring to FIGS. 3 and 4 there is shown an impeller 40 which is similar to the impeller shown and described in connection with FIGS. 1 and 2. The TCA and twist may be the same as with the impellers of FIGS. 1 and 2 thereby taking advantages of the surprising efficiency of the impeller over conventional mixing impellers. Another cause of inefficiency is the tip vortex that is the circulation around the tip of the blade from the pressure surface to the suction surface, that is in the upward direction which is contrary to the direction of pumping. It has been found in accordance with the invention that an arrangement of one or more slots (42 in the impeller shown in FIGS. 3, 4, 44 and 46 in the impeller blades shown in planform in FIG. 5) counteract or inhibit this contrary tip vortex flow from the pressure blade surface to the suction blade surface.

As shown in FIGS. 7A, B and C the slot 42 is trapezoidal in shape and tapers inwardly in an inward radial direction towards the rotation axis of the shaft 20. The radial depth of the slot is preferably 5–15% of the radial length of the blade with a 10% depth being presently preferred. The width of the slot may be one-third of the width of the slot and, in the case of the slot 42 the bisector or center line of the slot is the center line of the width of the blade at the tip. Flow through the slot is in an upward direction, that is from the pressure to the suction surface and then continues along the suction surface of the blade towards the trailing edge. The tip vortex which tends to counteract the main pumping action (down pumping) of the blade is located near the trailing edge of the blade. It is believed that the flow through the slot creates a condition similar to that of a fin or proplet along the tip of the blade and interferes with the formation of the tip vortex. In other words, the flow through the slot creates or blocks the vortex and establishes what may be considered to a fluid curtain in the path of the tip vortex flow. The tip vortex flow is sometimes called induced flow and is generally in a direction radially inward of the blade from the tip. The curtain established by the flow through the slot thus counteracts the vortex flow and inhibits the formation of the induced flow.

An arrangement of slots, such as two slots 44 and 46 (FIG. 5) may be used for example where the tip of the blade is wider than the blade shown in FIGS. 3 and 4 or where it is desirable to reduce the size of the slots from say 30% of the width at the tip to 20% each. The radial length of the slots, like the slots described in connection with FIGS. 3 and 4, may range between 5–15% of the radial length of the blade.

Figure 6:
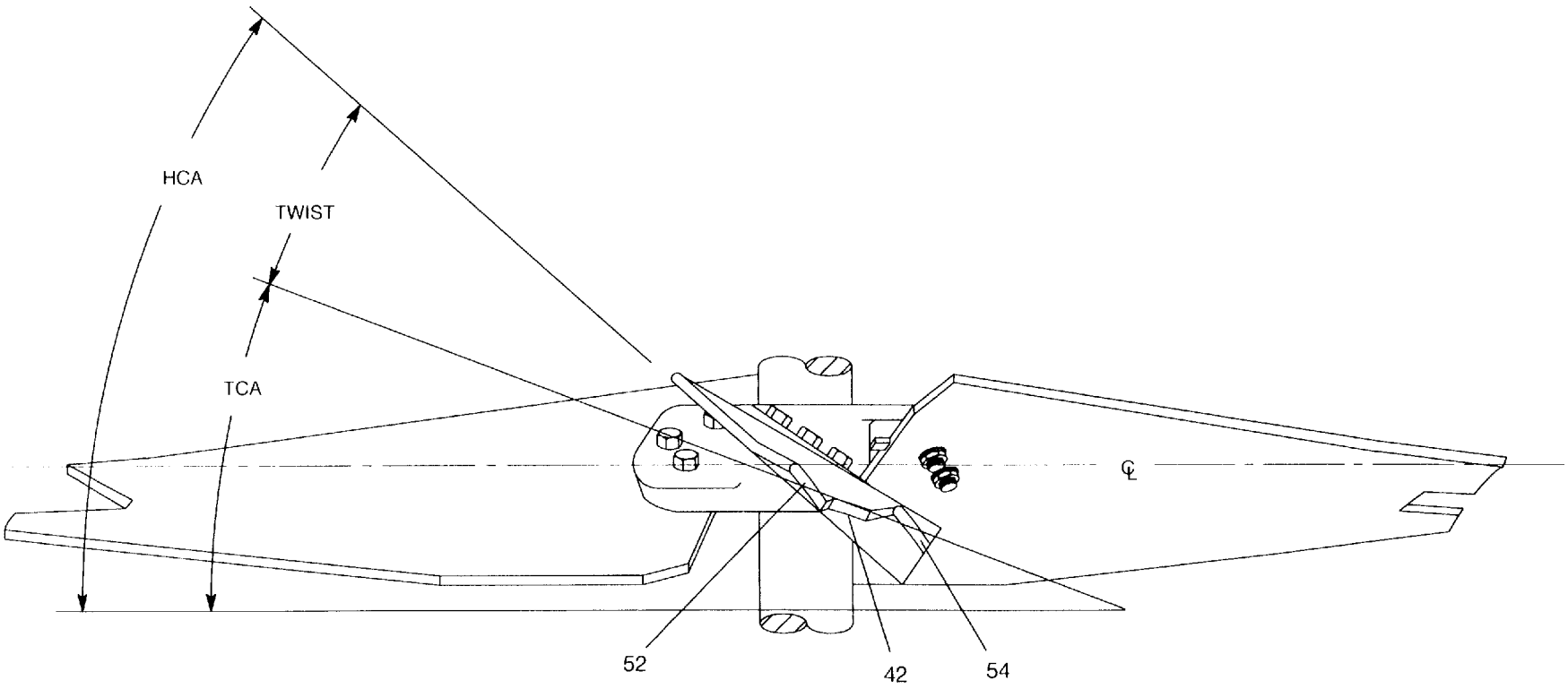
FIG. 6 is a plan view of an impeller similar to the impeller shown in FIGS. 3 and 4, but where the segments of the impeller on opposite sides of the slot are twisted to generate vortices for imparting shear to the material being mixed.
Figure 6A:
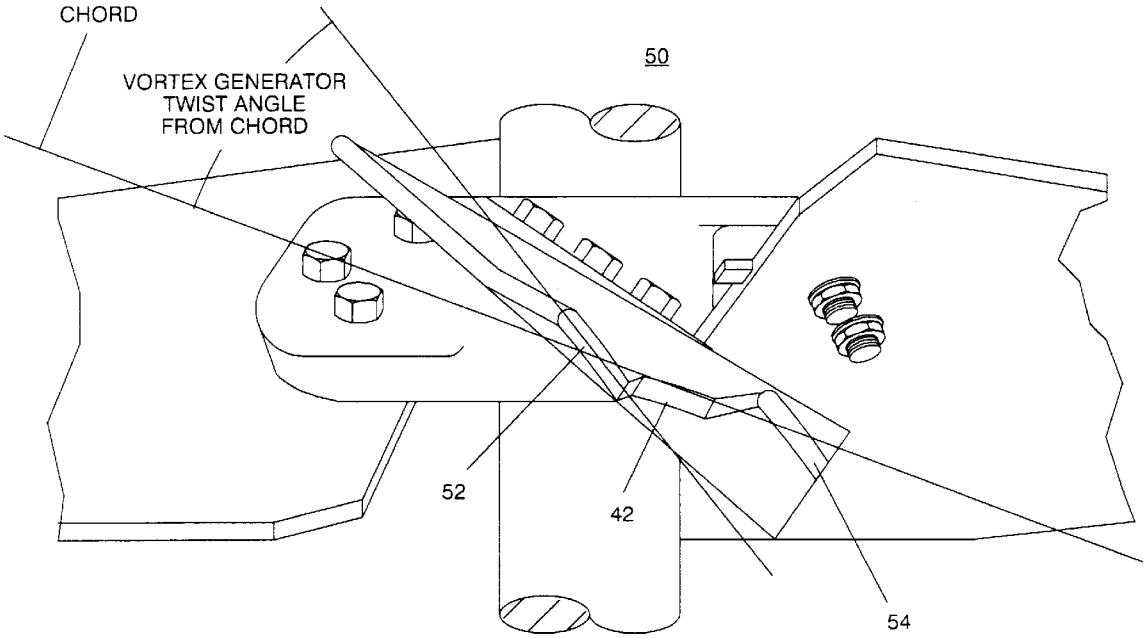
FIG. 6A is an enlarged view showing the twisted segments of the impeller illustrated in FIG. 6.

Referring to FIGS. 6 and 7 there is shown an impeller 50 similar to the impeller described in connection with FIGS. 3 and 4 that is the impeller has slots 42 extending radially inward from the tips thereof. The segments 52 and 54 (shown enlarged in FIGS. 6A) are twisted both upwardly that is in the same direction to provide vortex generators. In other words, the effective TCA remains the same in the impeller but the twisted segments are at different angles which in the case of the impeller 50 are at angles greater than the TCA. The segments are shown at an angle of approximately 45° to the chord at the tip.

In operation, the segments intercept the flow and create vortices around the tip where the impeller is rotating at its highest velocity. The shear forces on the media in the tank are therefore at the highest level available for the diameter of the impeller. Impellers 50 having their segments twisted may be used in processes where the materials require shear forces rather than merely circulation or solid suspension. Conventionally where shear is required more than one impeller was required or flow efficiency (Q/P) was sacrificed in order to obtain shear. The impeller having the twisted segments provide shear while maintaining flow efficiency.

Referring to the FIGS. 8 and 9 there is shown an end view towards the tip of a blade having a pair of slots 70 and 72.

The segments 74, 76 and 78 are twisted at different angles so as to provide different shear forces. The segments 80, 82 and 84 of the impeller shown in FIG. 9 are twisted in different directions so as to establish another shearing flow pattern. The segments on different blades of a multi-blade impeller may be twisted in different directions or to different extents so as to provide different flow patterns meeting specific process requirements and applications. Such arrangements may be especially useful where the impeller system is operating in the transitional flow regime. Then, segments tend to disperse stationary vortices in the tank.

From the foregoing description it will be apparent that there has been provided improved impeller systems and impellers for use in such systems. Variations and modifications in the herein described impellers and impeller systems, within the scope of the invention, will undoubtedly suggest themselves to those skilled in the art. Accordingly, the foregoing description should be taken as illustrative and not in a limiting sense.

What is claimed is:

1. An axial flow impeller rotatable by a shaft in a tank of certain diameter, said impeller having blades, opposite ends of said blades respectively, defining tips and attachments to said shaft, the blades having a certain diameter defined by said tips, said blades having a blade angle at said tips (TCA) and having a blade angle at said attachments, said blades having twist which is the difference between the blade angle at said opposite ends, said impeller being characterized in that the flow efficiency (Q) for applied shaft rotating power (P) is optimized by having said blade angle at said tips (TCA) inversely related to the twist of said impeller.

2. The impeller according to claim 1 wherein the blade angle at said tips is different from the blade angle at said tips for optimum efficiency and said twist is less than the twist of said impeller for said optimum efficiency.

3. The impeller according to claim 2 wherein said inverse relationship increases or maintains the efficiency of said impeller at the efficiency thereof where said blade angle at said tips and twist provide said optimum efficiency.

4. The impeller according to claim 1 wherein said impeller is selected from a group of different impellers having different TCAs but a lesser number of angles at the end attachable to said shaft than the number of impellers in said group.

5. The impeller according to claim 1 wherein said blade angle at said tips is greater than 22° and said twist is less than 12°.

6. The impeller according to claim 1 where said blade angle is about 32° at said tips and said twist is about 2°.

7. The impeller according to claim 1 where said blade angle is about 22° at said tips and said twist is about 12°.

8. The impeller according to claim 1 wherein said blade angle at said tips is 12° and said twist is 12°.

9. The impeller according to claim 1 where said blades of said impeller have camber.

10. The impeller according to claim 1 wherein the width of said blades increases radially from the tips to approximately 40% of the radius of the impeller from 10% to 15% of the diameter of the impeller or remains approximately constant at widths up to 50% of the diameter between the opposite ends of said blades.

11. An impeller according to claim 1 having at least one slot extending radially inwardly from the tips thereof a distance from 5% to 15% of the radius of the impeller blade.

12. The impeller according to claim 11 is where said slots are of trapezoidal shape and taper inwardly towards the shaft.

13. An impeller according to claim 11 wherein a plurality of said slots are provided each extending radially inwardly from said tip of a blade of said impeller.

14. The impeller according to claim 13 having segments on opposite sides of said slots twisted to define vortex generators for generating shear forces in the media circulated by said impeller.

15. The impeller according to claim 14 wherein said segments are twisted at different angles or in different directions.

* * * * *